US008573176B2

(12) United States Patent
Fujii

(10) Patent No.: US 8,573,176 B2
(45) Date of Patent: Nov. 5, 2013

(54) CRANK CHAMBER COMMUNICATION STRUCTURE OF MULTI-CYLINDER INTERNAL COMBUSTION ENGINE

(75) Inventor: Manabu Fujii, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 313 days.

(21) Appl. No.: 13/146,742

(22) PCT Filed: Feb. 2, 2010

(86) PCT No.: PCT/IB2010/000197

§ 371 (c)(1),
(2), (4) Date: Jul. 28, 2011

(87) PCT Pub. No.: WO2010/089648

PCT Pub. Date: Aug. 12, 2010

(65) Prior Publication Data

US 2011/0283964 A1 Nov. 24, 2011

(30) Foreign Application Priority Data

Feb. 4, 2009 (JP) ..... 2009-023882

(51) Int. Cl.
*F02B 75/22* (2006.01)

(52) U.S. Cl.
USPC ..... 123/195 R

(58) Field of Classification Search
USPC ..... 123/195 R
See application file for complete search history.

(56) References Cited

U.S. PATENT DOCUMENTS 5,829,406 A 11/1998 Mazzola et al.

FOREIGN PATENT DOCUMENTS

| | | | |
|---|---|---|---|
| DE | 38 05 389 | A1 | 8/1989 |
| DE | 10 2005 003 934 | A1 | 8/2006 |
| DE | 10 2006 024 048 | A1 | 11/2007 |
| JP | A-07-145717 | | 6/1995 |
| JP | A-2004-316556 | | 11/2004 |
| JP | A-2005-315125 | | 11/2005 |
| JP | A-2007-321615 | | 12/2007 |

OTHER PUBLICATIONS

International Search Report issued in International Patent Application No. PCT/IB2010/000197 dated May 20, 2010.
Written Opinion issued in International Patent Application No. PCT/IB2010/000197 dated May 20, 2010.
International Preliminary Report on Patentability issued in International Patent Application No. PCT/IB2010/000197 dated Apr. 7, 2011.

*Primary Examiner* — Noah Kamen
(74) *Attorney, Agent, or Firm* — Oliff and Berridge, PLC

(57) ABSTRACT

A crank chamber communication structure for a multi-cylinder internal combustion engine having a plurality of partition walls that are formed by a cylinder block and a crankcase, that are formed to support a crankshaft and to define a plurality of crank chambers that correspond to the plurality of cylinders, the structure including: a plurality of respective first communicating holes formed in the plurality of partition walls for communication between respective pairs of adjoining crank chambers separated by an interposed partition wall; and a second communicating hole that is formed at least either of the cylinder block or the crankcase, and that is interposed between a pair of non-adjoining crank chambers between which at least two partition walls among the plurality of partition walls are interposed for direct communication between the pair of non-adjoining crank chambers.

9 Claims, 10 Drawing Sheets

FIG. 7B
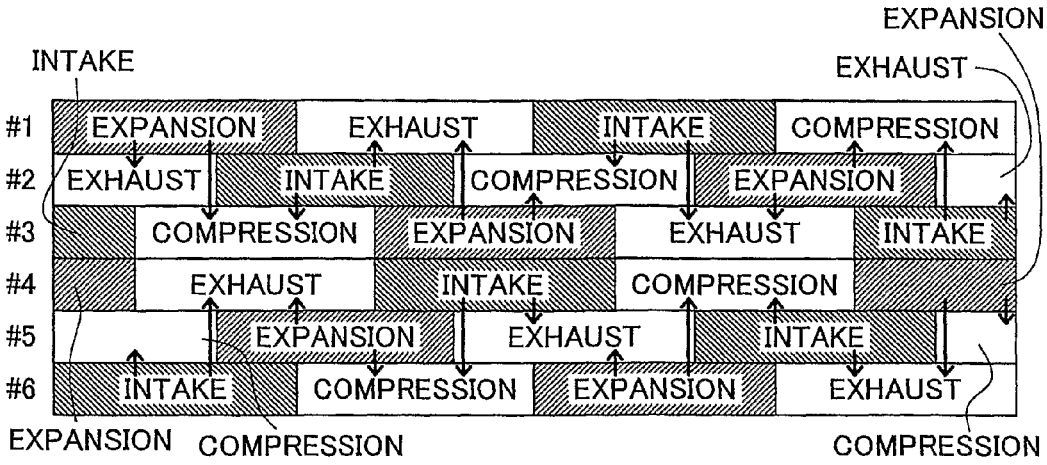
FIG. 7C
| | | | | | |
|---|---|---|---|---|---|
| 1→2 | 2→3 | 3→1 | 1→2 | 2→3 | 3→1 |
| 6→5 | 5→4 | 4→6 | 6→5 | 5→4 | 4→6 |
FIG. 7D
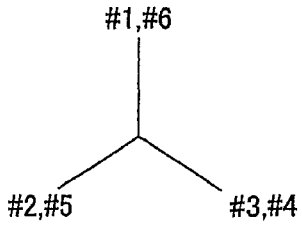

CRANK CHAMBER COMMUNICATION STRUCTURE OF MULTI-CYLINDER INTERNAL COMBUSTION ENGINE

BACKGROUND OF THE INVENTION

1. Field of the Invention

The present invention relates to a crank chamber communication structure of a multi-cylinder internal combustion engine, and particularly relates to a crank chamber communication structure of a multi-cylinder internal combustion engine in which a breather is formed between adjoining crank chambers in a crankcase.

2. Description of the Related Art

In a multi-cylinder internal combustion engine, the propulsive force of pistons that receive combustion pressure in cylinders is transmitted to the crankpins of a crankshaft corresponding to the respective cylinders, and the propulsive force is converted into rotation of the crankshaft. Therefore, the crankshaft is often supported by partition walls that are disposed between spaces in the crankcase that correspond to an adjoining cylinder, in other words, a crank chamber via bearings. Further, because pumping loss may be reduced when air (including air, blow-by gas, and so forth) is allowed to move between the adjoining cylinders while the pistons of the adjoining cylinders move in opposite directions, it is known that communicating holes are provided in the partition walls to allow movement of air.

In a crank chamber communication structure of a multi-cylinder internal combustion engine that has such a communicating hole, for example, a generally cylindrical cylinder inner wall in which the piston slides is formed separately from a cylinder block. Further, a protruding end is provided on the cylinder inner wall to protrude in the axial direction in a vicinity of the partition wall so that fastening force of a cylinder head to the cylinder block is transmitted to a section of the partition wall between the adjoining crank chambers, through which the crankshaft passes, as a compressive load via the cylinder inner wall. This prevents the formation of cracks and so forth in the crankshaft pass-through section of the partition wall. Such a communication structure is described, for example, in Japanese Patent Application Publication No. 2005-315125 (JP-A-2005-315125).

A clearance groove for the communicating hole processing between the adjoining crank chambers is formed in a top section of the partition wall. The communicating hole is formed by horning, from a bottom of the clearance groove, in a section of the partition wall that is integral with a partition wall between cylinders on the cylinder block side. Thereby, the partition wall around the communicating hole can be formed to have a thick wall and prevent stress concentration. Such a communication structure is described, for example, in Japanese Patent Application Publication No. 2007-321615 (JP-A-2007-321615).

Further, the communicating holes that have opening areas or opening shapes different from each other are formed in a plurality of partition walls between crank chambers of a plurality of cylinders. This allows obtainment of a sufficient opening area of the communicating holes and facilitates removal of cores during molding of the cylinder block. Such a communication structure is described, for example, in Japanese Patent Application Publication No. 2004-316556 (JP-A-2004-316556).

In the above-described crank chamber communication structure of a multi-cylinder internal combustion engine, if crank pin positions on the crankshaft are inverted at 180° between the adjoining cylinders as in an in-line four-cylinder engine, air may be moved back and forth between the adjoining crank chambers in a manner such that pressure fluctuation due to reciprocating motion of the pistons is relieved alternately between the adjoining crank chambers, thereby effectively reducing pumping loss. However, in multi-cylinder engines in which the relationship cannot be achieved such that the phases of the pistons are opposite between the adjoining cylinders, such as in-line multi-cylinder engines that have three cylinders, five cylinders, six or more cylinders and V-type engines, pumping loss cannot be certainly reduced.

Specifically, for example, if the pistons of a plurality of adjoining cylinders move in the same direction among the crank chambers corresponding to three or more cylinders and thus air flows toward one side in the cylinder arrangement direction through the communication hole, air is not released at the most downstream cylinder that is positioned at the end of the engine. At the cylinder, the piston pushes the air out to (pushes air back to) the adjoining cylinder against air flow. This results in pumping loss.

Further, in the multi-cylinder engines in which the relationship cannot be achieved such that the phases of the pistons are opposite between the adjoining cylinders, because there is no point that speeds of the pistons of the adjoining cylinders simultaneously becomes zero, the back-and-forth movement of the air itself becomes very complicated. Therefore, pumping loss is apt to occur not only at the cylinder that is positioned at the end but also at the other cylinders.

SUMMARY OF THE INVENTION

The present invention provides a crank chamber communication structure of a multi-cylinder internal combustion engine that can more certainly reduce pumping loss.

A first aspect of the present invention provides a crank chamber communication structure for a multi-cylinder internal combustion engine having a plurality of partition walls that are formed in a cylinder block that forms a plurality of, three or more, cylinders each of which houses a piston and a crankcase that is fastened and fixed to the cylinder block, the partition walls are formed to support a crankshaft and to define a plurality of crank chambers that correspond to the plurality of cylinders, the crank chamber communication structure including: a plurality of respective first communicating holes formed in the plurality of partition walls for communication between respective pairs of adjoining crank chambers separated by an interposed partition wall; and a second communicating hole that is formed at least either of the cylinder block or the crankcase, and that is interposed between a first pair of non-adjoining crank chambers between which at least two partition walls among the plurality of partition walls are interposed for direct communication between the first pair of non-adjoining crank chambers.

Such a configuration allows gases to move between the non-adjoining cylinders in the case that the pistons of the adjoining cylinders move in the same direction and prevents the piston from pushing gases against a gas flow. Accordingly, pumping loss can be reduced.

The crank chamber communication structure in accordance with the first aspect, the first pair of non-adjoining crank chambers may be formed in spaces that are positioned inside the pair of respective cylinders among the plurality of cylinders which are positioned at both ends of the cylinder block and that are positioned more adjacent to the crankshaft than the pistons.

Such a configuration allows gases to move between the non-adjoining cylinders even if one of the adjoining cylinders is positioned at the end in the cylinder arrangement direction in the case that the pistons of the adjoining cylinders move in the same direction. Accordingly, pumping loss can be more certainly reduced.

The crank chamber communication structure in accordance with the first aspect, the first pair of non-adjoining crank chambers may be formed in spaces that are positioned inside a first outer cylinder among the plurality of cylinders which is positioned at one end of the cylinder block and inside a first inner cylinder which is separated from the first outer cylinder toward a center of the cylinder block, and that are positioned more adjacent to the crankshaft than the pistons.

In such a configuration, even if gases flow from the center of the cylinder block toward one end thereof or flow in the opposite direction in the multi-cylinder internal combustion engine, the gas flow is not blocked at the crank chamber corresponding to the cylinder at the end, but is allowed to flow between the non-adjoining cylinders. Therefore, pumping loss can be more certainly reduced.

The crank chamber communication structure in accordance with the first aspect, crank chamber communication structure may have: a second pair of non-adjoining crank chambers that are separated from the first pair of non-adjoining crank chambers and formed in spaces that are positioned inside A second outer cylinder among the plurality of cylinders which is positioned at the other end of the cylinder block and inside a second inner cylinder which is separated from the second outer cylinder toward the center of the cylinder block with any of the plurality of cylinders interposed therebetween and that are positioned more adjacent to the crankshaft than the pistons; and another second communicating hole for direct communication between the second pair of non-adjoining crank chambers, that is formed at least either of the cylinder block or the crankcase.

In such a configuration, even if gases flow from the center of the cylinder block toward one end and the other end thereof or flow in the opposite direction in the multi-cylinder internal combustion engine, the gas flow is not blocked at the crank chambers corresponding to the cylinders at the ends, but is allowed to flow back and forth between the cylinders at both the ends and the non-adjoining cylinders. Therefore, pumping loss can be more certainly reduced.

The crank chamber communication structure in accordance with the first aspect, the second communicating hole may be formed with a pipe that passes through any of the plurality of partition walls.

Such a configuration facilitates formation of the second communicating hole.

The crank chamber communication structure in accordance with the first aspect, the pipe may be formed of metal.

The crank chamber communication structure in accordance with the first aspect, the second communicating hole and the first communicating holes may be separated from each other in wall surface directions of the partition walls so that the second communicating hole and the first communicating holes are positioned at opposite ends within the plurality of cylinders interposed to the holes.

Such a configuration allows obtainment of sufficient opening areas of the first communicating holes and the second communicating hole and facilitates a process for forming the openings of the communicating holes.

The crank chamber communication structure in accordance with the first aspect, the crankshaft may have a phase difference of the pistons, which is different from 180°, between each pair of the cylinders that adjoin each other with the partition wall interposed therebetween.

Such a configuration can effectively reduce pumping loss in the multi-cylinder internal combustion engine that pumping loss is apt to occur.

A second aspect of the present invention provides a crank chamber communication structure of a multi-cylinder internal combustion engine, having: a cylinder block that forms a plurality of, three or more, cylinders each of which houses a piston; a crankcase that is fixed to the cylinder block; and the plurality of partition walls that are formed with the cylinder block and the crankcase to support a crankshaft and to define a plurality of crank chambers which correspond to the plurality of cylinders, the crank chamber communication structure including: a plurality of first communicating holes that are formed in at least two of the plurality of partition walls and that communicate between respective pairs of the adjoining crank chambers separated by an interposed partition wall;

and a second communicating hole that is interposed between a pair of the non-adjoining crank chambers between which at least two of the plurality of partition walls are interposed and that directly communicates between the pair of non-adjoining crank chambers.

The present invention allows gases to move between the non-adjoining cylinders in the case that the pistons of the adjoining cylinders move in the same direction and prevents the piston from pushing gases out against gas flow. Therefore, the present invention can provide a crank chamber communication structure of a multi-cylinder internal combustion engine that can more certainly reduce pumping loss.

BRIEF DESCRIPTION OF THE DRAWINGS

The foregoing and/or further objects, features and advantages of the invention will become more apparent from the following description of example embodiments with reference to the accompanying drawings, in which like numerals are used to represent like elements and wherein:

FIG. 7B is an operation explanatory diagram of the crank chamber communication structure of a multi-cylinder internal combustion engine in accordance with the third embodiment of the present invention, and is a diagram that shows change in stroke of each cylinder of the multi-cylinder internal combustion engine and indicates movement direction of the air;

FIG. 7C is an operation explanatory diagram of the crank chamber communication structure of a multi-cylinder internal combustion engine in accordance with the third embodiment of the present invention, which indicates the main air movement between the cylinders by cylinder numbers; and FIG. 7D is an operation explanatory diagram of the crank chamber communication structure of a multi-cylinder internal combustion engine in accordance with the third embodiment of the present invention, which shows the positions of the crankpins of the crankshaft.

DETAILED DESCRIPTION OF EMBODIMENTS

Embodiments of the present invention will be described hereinafter with reference to drawings.

FIGS. 1 to 3 are diagrams that show a crank chamber communication structure of a multi-cylinder internal combustion engine in accordance with a first embodiment of the present invention, and show an engine that is installed as a multi-cylinder internal combustion engine in an automobile.

First, a configuration of the multi-cylinder internal combustion engine in accordance with the first embodiment of the present invention will be described.

Figure 1A:
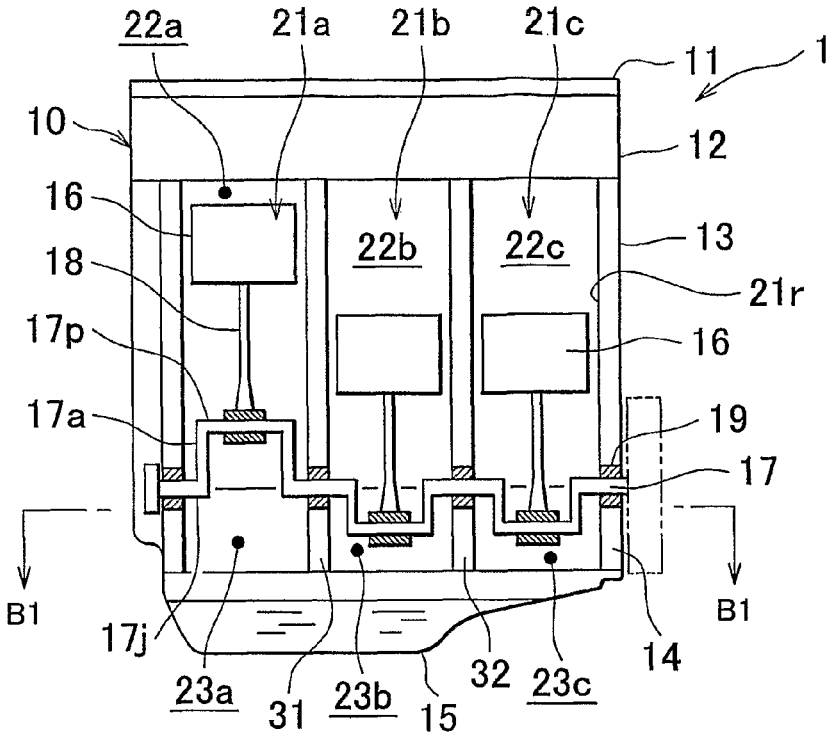
FIG. 1A is a schematic cross-sectional view of the multi-cylinder internal combustion engine that shows the structure of a crank chamber communication structure of a multi-cylinder internal combustion engine in accordance with a first embodiment of the present invention.

The engine 1 shown in FIG. 1A in a cross section includes an engine main body 10 that has, in the order from the top, a head cover 11, a cylinder head 12, a cylinder block 13, a crank case 14, and an oil pan 15. The engine main body 10 has three cylinders 21*a*, 21*b*, and 21*c*. Each of the cylinders 21*a* to 21*c* houses a piston 16. A crankshaft 17 is connected to the piston 16 via the connecting rod 18. Further, conventional valve mechanisms and ignition devices of a spark ignition type (all not shown) are housed inside an upper section of the engine main body 10. The valve mechanisms are driven by power from the crankshaft 17. Engine oil (hereinafter, simply referred to as "oil") for lubrication and cooling is housed in an oil pan 15 in a lower section of the engine main body 10.

Air is drawn into combustion chambers 22*a*, 22*b*, and 22*c* formed in upper sections in the respective cylinders 21*a* to 21*c* in the drawing via intake passages and intake ports (all not shown) in response to strokes of the pistons 16. Exhaust gas, generated after combustion in the combustion chambers 22*a* to 22*c*, is discharged through exhaust ports and exhaust passages (all not shown). The basic configuration of the engine 1 is similar to conventional configurations.

Figure 2A:
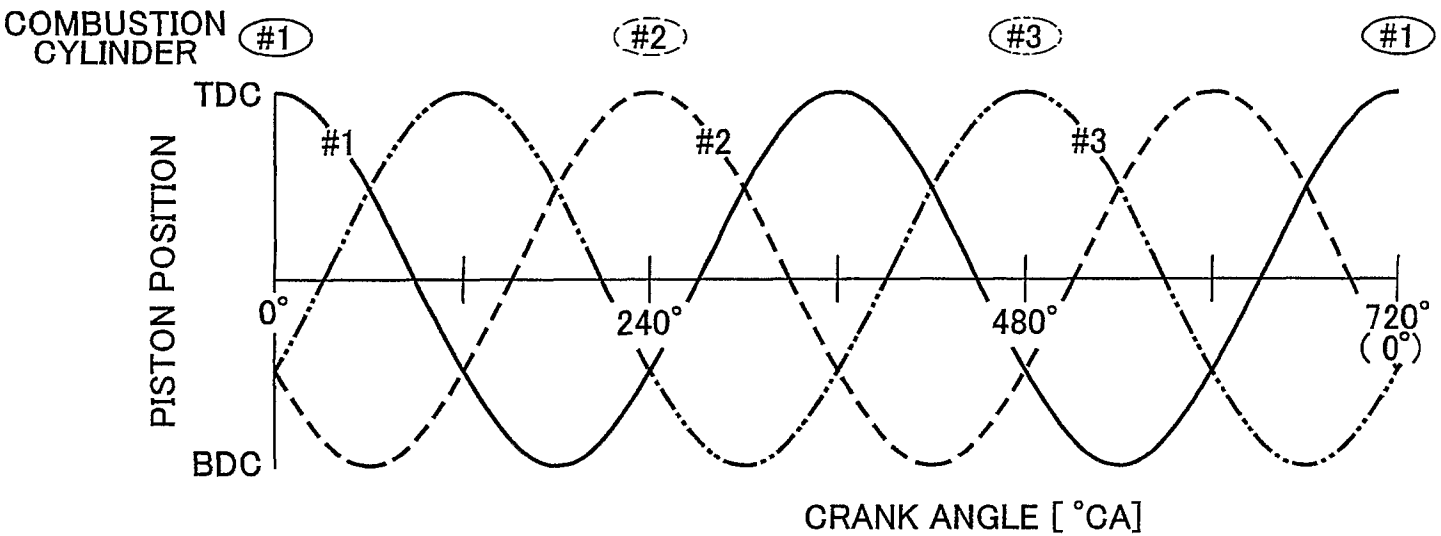
FIG. 2A is a graph that illustrates the operation of the crank chamber communication structure of a multi-cylinder internal combustion engine in accordance with the first embodiment of the present invention, and indicates the relationship between piston position and crank angle of each cylinder of the multi-cylinder internal combustion engine.
Figure 2B:
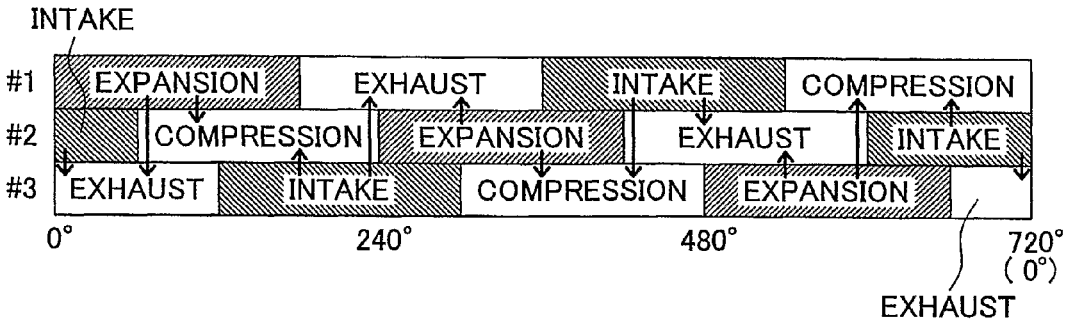
FIG. 2B is an operation explanatory diagram of the crank chamber communication structure of a multi-cylinder internal combustion engine in accordance with the first embodiment of the present invention, that shows change in stroke of each cylinder of the multi-cylinder internal combustion engine and indicates movement directions of gases.
Figure 2C:
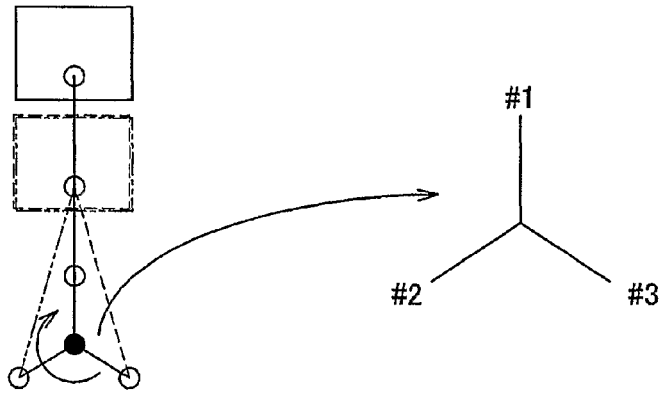
FIG. 2C is an operation explanatory diagram of the crank chamber communication structure of a multi-cylinder internal combustion engine in accordance with the first embodiment of the present invention, that shows an arrangement of crankpins of a crankshaft.

As shown in FIGS. 1A and 2C, the crankshaft 17 has crank journals 17*j* supported between the cylinder block 13 and the crankcase 14 via bearings 19 and crank arms 17*a* via which the crank journals 17*j* support three crankpins 17*p* that are positioned at every 120°.

In the engine main body 10, the cylinder block 13 that forms a plurality of (three or more) cylinders 21*a* to 21*c* each of which houses the piston 16, and the crankcase 14 that is fastened and fixed to the cylinder block 13 by a plurality of bolts (not shown) form a plurality of partition walls 31 and 32 that support the crankshaft 17. The plurality of partition walls 31 and 32 define and form a plurality of crank chambers 23*a*, 23*b*, and 23*c* that correspond to the plurality of cylinders 21*a* to 21*c*.

First communicating holes 31*a* and 32*a* are coaxially formed in partition walls 31 and 32 to permit mutual communication between the adjoining crank chambers.

In particular, the first communication hole 31*a* allows mutual communication between the adjoining crank chambers 23*a* and 23*b* that adjoin each other in the crankcase 14 with the partition wall 31 interposed therebetween and the first communicating hole 32*a* allows mutual communication between adjoining crank chambers 23*b* and 23*c* that adjoin each other in the crankcase 14 with the partition wall 32 interposed therebetween.

At least one of either the cylinder block 13 or the crankcase 14 includes a second communicating hole 35*a* that is interposed between a pair of the non-adjoining crank chambers 23*a* and 23*c* between which both the partition walls 31 and 32 (at least two of the partition walls) among the plurality of partition walls 31 and 32 are interposed in the crankcase 14 and that is for direct communication between the pair of non-adjoining crank chambers 23*a* and 23*c*.

Specifically, non-adjoining crank chambers 23*a* and 23*c* are formed in spaces that are positioned inside a pair of the cylinders 21*a* and 21*c* which are positioned at both ends of the cylinder block 13 among the plurality of the cylinders 21*a* to 21*c* and that are more adjacent to the crankshaft 17 than the pistons 16. The second communicating hole 35*a* may be formed from a single metal pipe 35 that passes through both the partition walls 31 and 32 and may have a circular cross section.

Figure 1B:
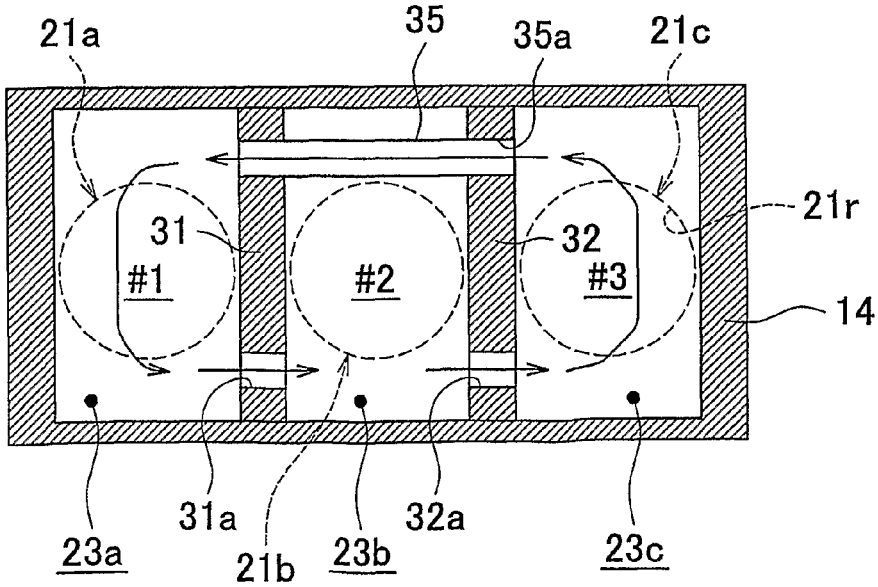
FIG. 1B is a cross-sectional view that is taken along line B1-B1 in FIG. 1A and a view in the direction of arrow.

As shown in FIG. 1B, the first communicating holes 31*a* and 32*a* are positioned below the plurality of cylinders 21*a* to 21*c* in the drawing. In contrast, the pipe 35 and the second communicating hole 35*a* of the pipe 35 are positioned above the plurality of cylinders 21*a* to 21*c* in the drawing. In other words, the second communicating hole 35*a* of the pipe 35 and the first communicating holes 31*a* and 32*a* are separated to each other in the wall surface direction (vertical direction in FIG. 1B) of each of the partition walls 31 and 32 so that they are positioned on the sides opposite to each other with cylinder bores 21*r* of the plurality of cylinders 21*a* to 21*c* interposed therebetween. In FIG. 1B, for convenience, the cross section of a portion that is below the crankshaft 17 is shown. However, the positions of the first communicating holes 31*a* and 32*a* and the second communicating hole 35*a* in the height direction are not limited to positions that are below the crankshaft 17. In other words, the plurality of communicating holes 31*a* and 32*a* and the second communicating hole 35*a* may be formed in sections of partition walls 31 and 32 that are below the rotational axis of the crankshaft 17 or may be formed in sections at or above the level of the rotational axis. Further, the plurality of communicating holes 31*a* and 32*a* need not be disposed on the same axis but may have different axes.

Because the crankpins 17*p* are provided at intervals of 120° as described above, a phase difference between the pistons 16 in the pair of cylinders 21*a* and 21*b* or the pair of cylinders 21*b* and 21*c* that adjoin each other with either of the plurality of partition walls 31 and 32 interposed therebetween is not 180°. Therefore, the pistons 16 do not reciprocatingly move in the opposite phase between the adjoining cylinders 21*a* and 21*b* or between the cylinders 21*b* and 21*c*.

Next, a processing method for installing the pipe 35 in the plurality of partition walls 31 and 32 (for example, lower half sections thereof) that are unitarily formed with the crankcase 14 will be described.

Figure 3A:
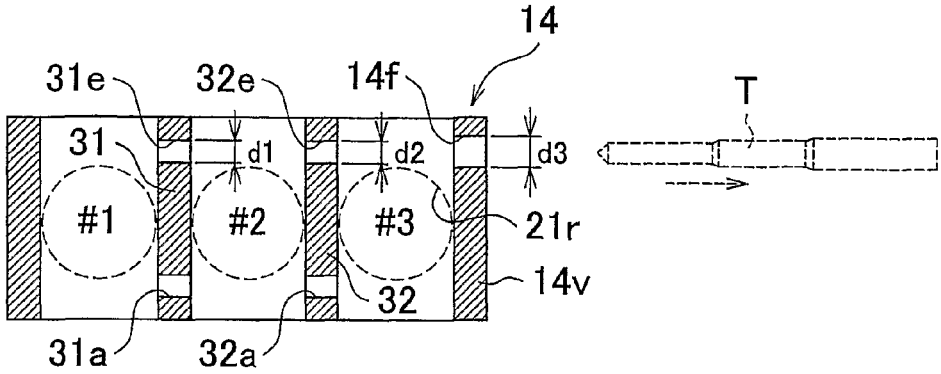
FIG. 3A is a process explanatory diagram of the crank chamber communication structure of a multi-cylinder internal combustion engine in accordance with the first embodiment of the present invention, that shows a process of boring holes in the crankcase.

As shown in FIG. 3A, though holes 31*e* and 32*e* that have inner diameters d1 and d2 (where d2>d1) are first formed in the partition walls 31 and 32 by a step boring tool T. A through hole 14*f* that has an inner diameter d3 (where d3>d2) is formed in an outer wall 14*v*. The differences between the inner diameters d1, d2, and d3 are set for facilitating work such as a hole process and a pipe insertion that will be described later.

Figure 3B:
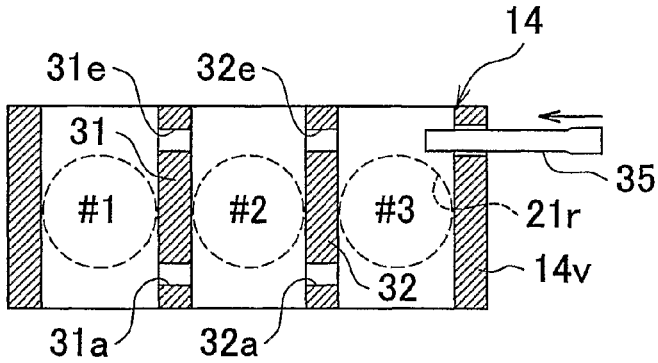
FIG. 3B is a process explanatory diagram of the crank chamber communication structure of a multi-cylinder internal combustion engine in accordance with the first embodiment of the present invention, that shows a process of installing a pipe.

Next, as shown in FIG. 3B, the pipe 35 is press-fitted into the through holes 31*e* and 32*e* of the partition walls 31 and 32 through the through hole 14*f*, or the pipe 35 is inserted into the through holes 31*e* and 32*e* of the partition walls 31 and 32 and thereafter ends of the pipe 35 are caulked, thereby fixing the pipe 35 to the plurality of partition walls 31 and 32. Due to the difference in inner diameter between the through holes 31*e* and 32*e*, the rear end of the pipe 35 (the right end in FIG. 3B) may have a diameter that is slightly larger than a front end of the pipe 35.

Figure 3C:
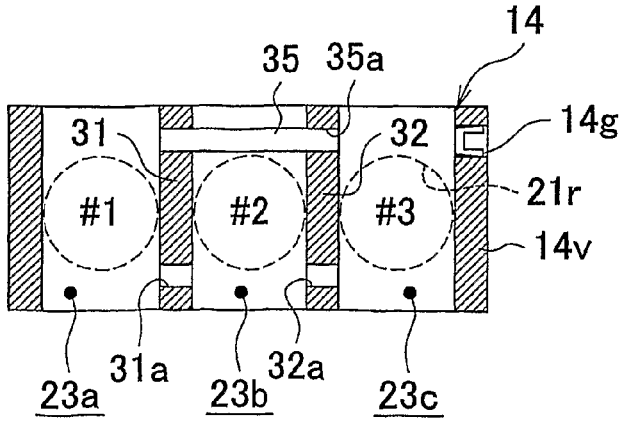
FIG. 3C is a process explanatory diagram of the crank chamber communication structure of a multi-cylinder internal combustion engine in accordance with the first embodiment of the present invention, that shows a process of blocking a hole of an outer wall.

Further, as shown in FIG. 3C, a plug member 14*g* to block the through hole 14*f* is installed as needed. An almost identical process is performed with respect to the sections of the plurality of partition walls 31 and 32 (for example, upper half sections thereof) that are unitarily formed with the cylinder block 13. However, if the outer wall 14*v* may be separated from the plurality of partition walls 31 and 32, the process for the through hole 14*f* may not be required.

Next, an effect will be described.

When the engine 1 of this embodiment that is configured as described above is operated, the pistons 16 in the cylinders 21*a*, 21*b*, and 21*c* reciprocate between top dead centers (TDC) and the bottom dead centers (BDC) while retaining the phase difference of 120° as shown in FIG. 2A.

In this state, in expansion and intake strokes, each of the pistons 16 moves downward from the top dead center to the bottom dead center. In exhaust and compression strokes, each of the pistons 16 moves upward from the bottom dead center to the top dead center.

FIG. 2B shows changes in the strokes in the plurality of cylinders 21*a* to 21*c* in two rotations (720° of crank angle) of the crankshaft 17. In the drawing, the strokes in which the pistons 16 move downward are hatched.

In each crank chamber 23*a*, 23*b*,and 23*c*, when the piston 16 moves down, gases are pushed out from the respective chamber through the plurality of first communication holes 31*a* and 32*a* and the second communication hole 35*a*. Then, when the piston 16 moves up, gases are drawn through the plurality of the first communication holes 31*a* and 32*a* and the second communication hole 35*a*. The movement of gases as shown by vertical arrows in FIG. 2B occurs in the crank chambers 23*a* to 23*c* in response to the changes in strokes of the plurality of cylinders 21*a* to 21*c*.

When the pistons 16 of the adjoining cylinders, for example, the first and second cylinders 21*a* and 21*b* move in the same direction, or when the pistons 16 of the second and third cylinders 21*b* and 21*c* move in the same direction, movement of gases is allowed between the non-adjoining cylinders 21*a* and 21*c*. Therefore, in any of the three cylinders 21*a* to 21*c*, the piston 16 does not push gases out against gas flow. This allows reduction of pumping loss.

In this embodiment, the pair of non-adjoining crank chambers 23*a* and 23*c* are the spaces that are positioned inside the pair of cylinders 21*a* and 21*c* which are positioned at both the ends of the cylinder block 13 among the plurality of cylinders 21*a* to 21*c* and that are more adjacent to the crankshaft 17 than the pistons 16. Therefore, when the pistons 16 of the adjoining cylinders 21*a* and 21*b* or 21*b* and 21*c* move in the same direction, and even if the cylinder 21*a* or 21*c* is positioned at the end in the cylinder arrangement direction, movement of gases is facilitated between the non-adjoining cylinders 21*a* and 21*c*. Accordingly, pumping losses may be reduced.

Further, the pipe 35 that passes through the plurality of partition walls 31 and 32 facilitates formation of the second communicating hole 35*a*.

In addition, in this embodiment, the second communicating hole 35*a* and the plurality of first communicating holes 31*a* and 32*a* of the plurality of the partition walls 31 and 32 are separated to each other in the wall surface directions of the plurality of the partition walls 31 and 32 so that they are positioned on the sides opposite to each other with the cylinder bores 21*r* of the plurality of cylinders 21*a* to 21*c* interposed therebetween. This allows obtainment of sufficient opening areas of the first communicating holes 31*a* and 32*a* and the second communicating hole 35*a* and facilitates the formation of openings in the communicating holes 31*a*, 32*a*, and 35*a*.

The phase difference between the pistons 16 of the pair of cylinders 21*a* and 21*b* or cylinders 21*b* and 21*c* that adjoin each other with either of the plurality of partition walls 31 and 32 interposed therebetween is different from 180°. Therefore, pumping loss would be apt to occur if it were a general multi-cylinder internal combustion engine. However, pumping loss may be effectively reduced.

As described above, in the crank chamber communication structure of a multi-cylinder internal combustion engine in accordance with this embodiment, movement of gases is allowed between the non-adjoining cylinders 21*a* and 21*c* is facilitated when the pistons 16 of the adjoining cylinders 21*a* and 21*b* or the cylinders 21 b and 21*c* move in the same direction. The piston 16 does not push gases out against gas flow. Accordingly, pumping losses may be reduced.

Figure 4:
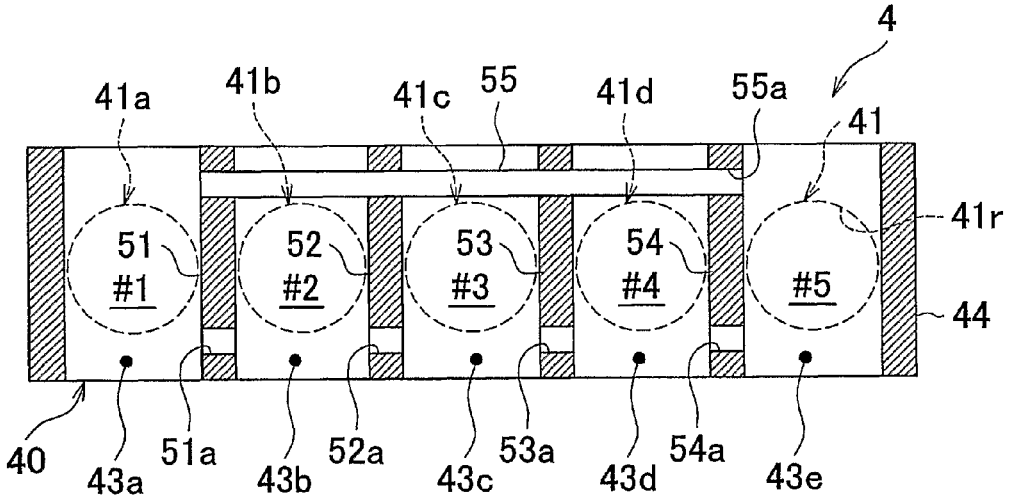
FIG. 4 is a top cross-sectional view of the inside of the crankcase that shows a crank chamber communication structure in accordance with a second embodiment of the present invention, and corresponds to FIG. 1B.

FIGS. 4 and 5 show a crank chamber communication structure of a multi-cylinder internal combustion engine in accordance with a second embodiment of the present invention. In FIG. 4, the lateral side walls of the crankcase and a crankshaft are not shown. In each of embodiments described below, structural elements that are same as or similar to the first embodiment will be described with the reference numerals and symbols of the correspondent constructing elements in FIG. 1.

The cross-section of an in-line five-cylinder internal combustion engine is shown in FIG. 4. An engine main body 40 has five cylinders 41*a*, 41*b*, 41*c*, 41*d*, and 41*e*. In the engine main body 40, a cylinder block (not shown) that has cylinder bores 41*r* which correspond to the five cylinders and a crankcase 44 that is fastened and fixed to the cylinder block by a plurality of bolts (not shown) form a plurality of partition walls 51, 52, 53, and 54 that support a crankshaft (not shown). The plurality of partition walls 51 to 54 define and form a plurality of crank chambers 43*a*, 43*b*, 43*c*, 43*d*, and 43*e* that correspond to the plurality of cylinders 41*a* to 41*e*.

The plurality of partition walls 51 to 54, for example, have a plurality of coaxial first communicating holes 51*a*, 52*a*, 53*a*, and 54*a* for direct communication between respective pairs of adjoining crank chambers in the crankcase 44 coaxially (on the same axis). Each pair of adjoining crank chambers adjoin each other with any one of partition walls 51 to 54 interposed therebetween. The plurality of first communicating holes 51*a*, 52*a*, 53*a*, and 54*a* are for mutual communication between adjoining crank chambers 43*a* and 43*b*, 43*b* and 43*c*, 43*c* and 43*d*, and 43*d* and 43*e;* respectively. Similar to the first embodiment, the plurality of first communicating holes 51*a* to 54*a* may also be disposed on different axes as well.

At least either the cylinder block or the crankcase 44 has a second communicating hole 55*a* that is interposed between a pair of the non-adjoining crank chambers (for example, a pair of the non-adjoining crank chambers 43*a* and 43*e*) between which at least two of the plurality of partition walls 51 to 54, for example, the four partition walls 51 to 54 are interposed in the crankcase 44 and that is for direct communication between the pair of non-adjoining crank chambers 43*a* and 43*e*.

Specifically, the pair of non-adjoining crank chambers 43*a* and 43*e* are formed in spaces that are positioned inside the cylinder bores 41*r* of a pair of the cylinders 41*a* and 41*e* which are positioned at the ends of the cylinder block 44 and the crankcase 44 among the plurality of the cylinders 41*a* to 41*e* and that are more adjacent to the crankshaft than the pistons 16. The second communicating hole 55*a* may be formed from a single metal pipe 55 that passes through the plurality of partition walls 51 to 54 and may have a circular cross section.

The plurality of first communicating holes 51*a*, 52*a*, 53*a*, and 54*a* are positioned below the plurality of cylinders 41*a* to 41*e* in FIG. 4. On the other hand, the pipe 55 and the second communicating hole 55*a* of the pipe 55 are positioned above the plurality of cylinders 41*a* to 41*e* in FIG. 4. In other words, the second communicating hole 55*a* in the pipe 55 and the plurality of first communicating holes 51*a*, 52*a*, 53*a*, and 54*a* are separated to each other in the wall surface direction (vertical direction in FIG. 4) of each of the partition walls 51, 52, 53 and 54 so that they are positioned on the sides opposite to each other with cylinder bores 41*r* of the plurality of cylinders 41*a* to 41*e* interposed therebetween.

Figure 5A:
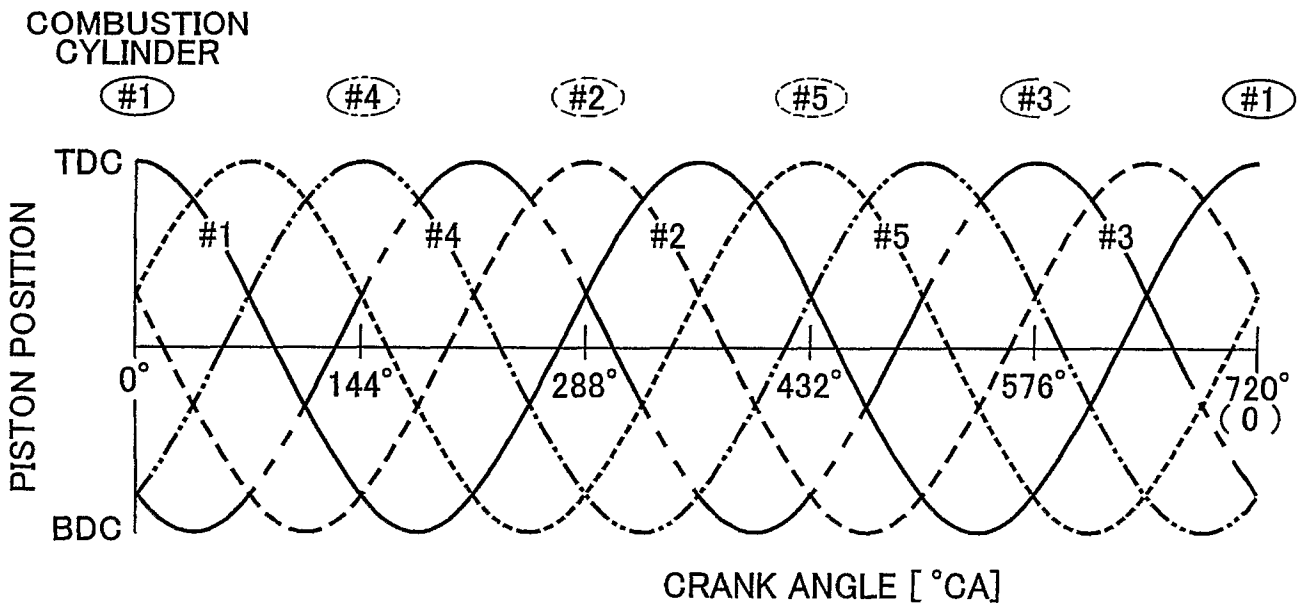
FIG. 5A is a graph that illustrates the operation of the crank chamber communication structure of a multi-cylinder internal combustion engine in accordance with the second embodiment of the present invention, indicating the relationship between piston position and crank angle of each cylinder of the multi-cylinder internal combustion engine.
Figure 5B:
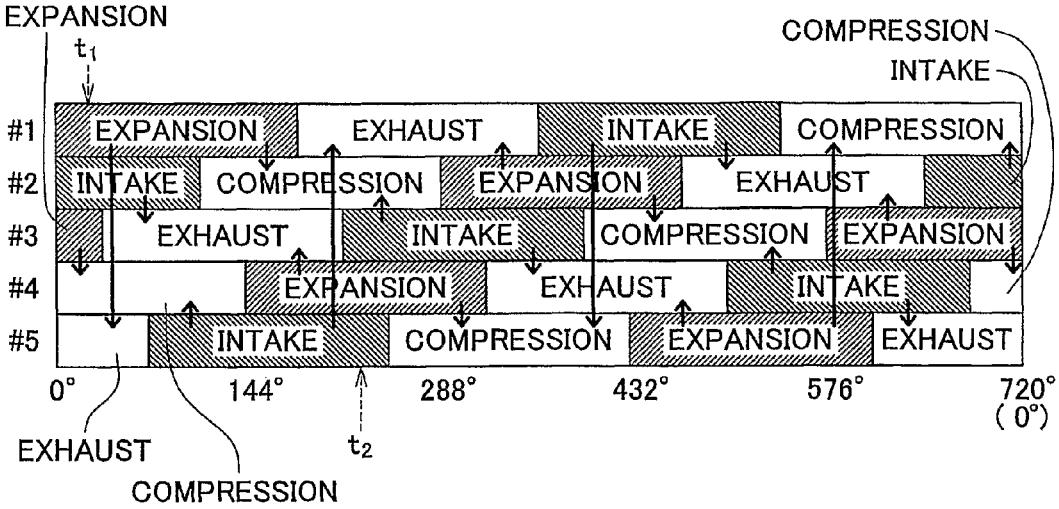
FIG. 5B is an operation explanatory diagram of the crank chamber communication structure of a multi-cylinder internal combustion engine in accordance with the second embodiment of the present invention, showing change in stroke of each cylinder of the multi-cylinder internal combustion engine and indicates moving directions of gases.
Figure 5C:
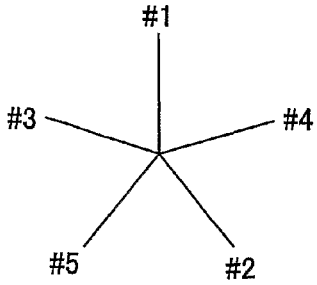
FIG. 5C is an operation explanatory diagram of the crank chamber communication structure of a multi-cylinder internal combustion engine in accordance with the second embodiment of the present invention, that shows positions of the crankpins of the crankshaft.

Further, as shown in FIG. 5C, crankpins are provided on the crankshaft at angular intervals determined by dividing 360° by the number of cylinders (e.g., 72° for five cylinders). A phase difference between adjoining pistons separated by any of the partition walls 51 to 54, such as the cylinders 41*a* and 41*b*, is different from 180°.

In this embodiment, when the engine 4 is operated, the pistons 16 in the cylinders 41*a* to 41*e* reciprocate between the top dead centers (TDC) and the bottom dead centers (BDC) while retaining the phase difference of 72° as shown in FIG. 5A. In expansion and intake strokes, each piston 16 moves down from the top dead center to the bottom dead center. In exhaust and compression strokes, each piston 16 moves up from the bottom dead center to the top dead center.

FIG. 5B shows changes in strokes in the plurality of cylinders 41*a* to 41*e* in two rotations (720° of crank angle) of the crankshaft 17. In the drawing, the strokes in which the pistons 16 are moving down are hatched.

In each crank chamber 43*a* to 43*e*, when the piston 16 moves down, air is pushed out from the concerned chamber through the plurality of first communication holes 51*a*, 52*a*, 53*a*, and 54*a* and the second communication hole 55*a*. In contrast, when the piston 16 moves up, gases are drawn through the plurality of the first communication holes 51*a*, 52*a*, 53*a*, and 54*a* and the second communication hole 55*a*. Movement of gases as shown by vertical arrows in FIG. 5B occurs in the crank chambers 43*a* to 43*e* in response to changes in strokes of the plurality of cylinders 41*a* to 41*e*.

At this point, when the pistons 16 of the adjoining cylinders, for example, the first and second cylinders 41*a* and 41*b* move in the same direction, when the pistons 16 of the fourth and fifth cylinders 41*d* and 41*e* move in the same direction, or when the pistons 16 in the three adjoining cylinders, for example, the cylinders 41*a* to 41*c* (#1 to #3 in the drawing) or 41*c* to 41*e* (#3 to #5 in the drawing) move in the same direction as indicated at two times t1 and t2 in FIG. 5B, movement of the air is allowed between the non-adjoining cylinders 41*a* and 41*e*. Therefore, in any of the five cylinders 41*a* to 41*e*, the piston 16 does not push air out against gas flow. Accordingly, an effect equivalent to the above-described first embodiment can be obtained.

Figure 6:
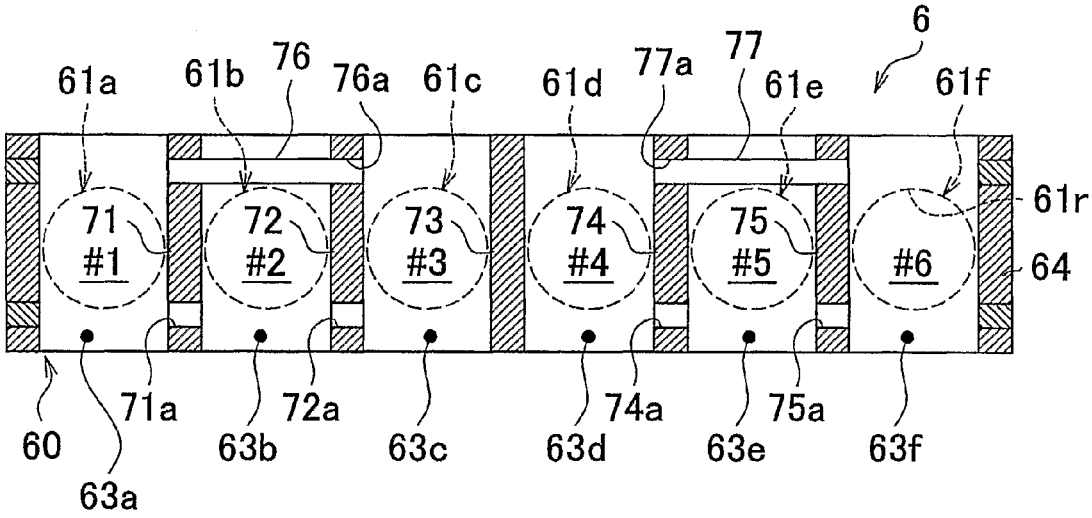
FIG. 6 is a top cross-sectional view of the inside of the crankcase that shows the structure of a crank chamber communication structure of a multi-cylinder internal combustion engine in accordance with a third embodiment of the present invention.

FIGS. 6 and 7 show a crank chamber communication structure of a multi-cylinder internal combustion engine in accordance with a third embodiment of the present invention. In FIG. 6, both lateral side walls of the crankcase and the crankshaft are not shown.

As shown in FIG. 6, an engine 6 of this embodiment is an in-line six-cylinder internal combustion engine type. The engine main body 60 has six cylinders 61*a*, 61*b*, 61*c*, 61*d*, 61*e*, and 61*f*. In the engine main body 60, a cylinder block (not shown) that has cylinder bores 61*r* which correspond to the six cylinders and a crankcase 64 that is fastened and fixed to the cylinder block by a plurality of bolts (not shown) form a plurality of partition walls 71, 72, 73, 74, and 75 that support a crankshaft (not shown). The plurality of partition walls 71 to 75 define and form a plurality of crank chambers 63*a*, 63*b*, 63*c*, 63*d*, 63*e*, and 63*f* that correspond to the plurality of cylinders 61*a* to 61*f*.

The four partition walls 71, 72, 74, and 75 among the plurality of partition walls 71 to 75 coaxially (on the same axis) have a plurality of first communicating holes 71*a*, 72*a*, 74*a*, and 75*a* for direct communication between respective pairs of the adjoining crank chambers in the crankcase 64. Each pair of adjoining crank chambers is separated by one of the partition walls 71, 72, 74, and 75. The plurality of first communicating holes 71*a*, 72*a*, 74*a*, and 75*a* are for mutual communication between adjoining crank chambers 63*a* and 63*b*, 63*b* and 63*c*, 63*d* and 63*e*, and 63*e* and 63*f*, respectively.

At least either the cylinder block or the crankcase 64 has two second communicating holes 76*a* and 77*a*. Each of the second communicating holes 76*a* and 77*a* is interposed between a pair of the non-adjoining crank chambers (for example, a pair of the non-adjoining crank chambers 63*a* and 63*c* or crank chambers 63*d* and 63*f*) between which at least two of the plurality of partition walls 71 to 75, for example, the two partition walls 71 and 72 or the two partition walls 74 and 75 are interposed in the crankcase 64 (and/or the cylinder block). The second communicating holes 76*a* and 77*a* are for direct communication between the pair of non-adjoining crank chambers 63*a* and 63*c* and between the non-adjoining crank chambers 63*d* and 63*f*, respectively.

Specifically, the pair of non-adjoining crank chambers 63*a* and 63*c* are formed in spaces that are positioned inside the first outer cylinder 61*a* which is positioned at one end of the cylinder block and the crankcase 64 among the plurality of cylinders 61*a* to 61*f* and inside the first inner cylinder 61*c* which is separated from the first outer cylinder 61*a* toward the center of the cylinder block and the crankcase 64 and that are more adjacent to the crankshaft than the pistons 16. The pair of non-adjoining crank chambers 63*a* and 63*c* mutually communicate through the second communicating hole 76*a*.

The other pair of non-adjoining crank chambers 63*d* and 63*f* are formed separately from the pair of non-adjoining crank chambers 63*a* and 63*c* in the crankcase 64.

Those are formed in spaces that are positioned inside the second outer cylinder 61*f* which is positioned at the other end of the cylinder block and the crankcase 64 among the plurality of cylinders 61*a* to 61*f* and inside the second inner cylinder 61*d* which is separated from the second outer cylinder 61*f* toward the center of the cylinder block and the crankcase 64 with any of the plurality of cylinders 61*a* to 61*f* interposed therebetween and that are more adjacent to the crankshaft than the piston 16. The other pair of non-adjoining crank chambers 63*d* and 63*f* mutually communicate through the other second communicating hole 77*a*.

Further, the plurality of first communicating holes 71*a*, 72*a*, 74*a*, and 75*a* are positioned below the plurality of cylinders 61*a* to 61*f* in the drawing. In contrast, the pipes 76 and 77 and the second communicating holes 76*a* and 77*a* in the pipes are positioned above the plurality of cylinders 61*a* to 61*f* in the drawing. In other words, the second communicating holes 76*a* and 77*a* in the pipe 76 and 77 and the plurality of first communicating holes 71*a*, 72*a*, 74*a*, and 75*a* are separated to each other in the wall surface direction (vertical direction in FIG. 6) of each of the partition walls 71, 72, 74 and 75 so that they are positioned at opposite ends of the cylinder bores 61*r* of the plurality of cylinders 61*a* to 61*f* interposed therebetween.

Further, as shown in FIG. 7D, the crankshaft has pairs of crankpins at regular intervals of 120°. A phase difference between the pistons 16 of the pair of cylinders 61*a* and 61*b*, and so forth, that adjoin each other with any of partition walls 71, 72, 74, and 75 interposed therebetween is different from 180°.

Figure 7A:
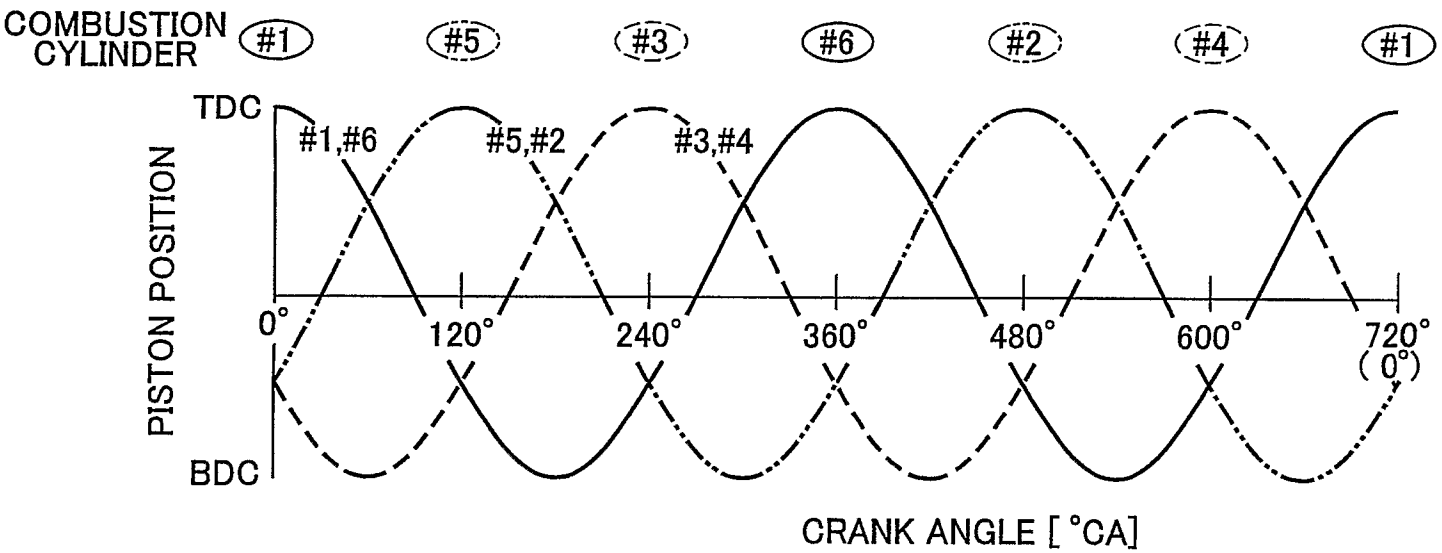
FIG. 7A is a graph that illustrates the operation of the crank chamber communication structure of a multi-cylinder internal combustion engine in accordance with the third embodiment of the present invention, and is a graph that indicates the relationship between piston position and crank angle of each cylinder of the multi-cylinder internal combustion engine.

In this embodiment, when the engine 6 is operated, each piston 16 in the cylinders 61*a* to 61*f* reciprocates between the top dead center (TDC) and the bottom dead center (BDC) in a manner such that, as shown in FIG. 7A, the pairs of the first and sixth cylinders (#1 and #6 in the drawing), the second and fifth cylinders (#2 and #5 in the drawing), and the third and fourth cylinders (#3 and #4 in the drawing) move in respectively same phases while retaining a phase difference of 120° between the pairs. In expansion and intake strokes, each piston 16 moves down from the top dead center to the bottom dead center. In exhaust and compression strokes, each piston 16 moves up from the bottom dead center to the top dead center.

FIG. 7B shows changes in strokes in the plurality of cylinders 61*a* to 61*f* in two rotations (720° of crank angle) of the crankshaft 17. In the drawing, the strokes in which the pistons 16 are moving down are hatched.

In each crank chamber 63*a* to 63*f*, when the piston 16 moves down, air is pushed out from the concerned chamber through the plurality of first communication holes 71*a*, 72*a*, 74*a*, and 75*a* and the second communication holes 76*a* and 77*a*. In contrast, when the piston 16 moves up, air is drawn through the plurality of the first communication holes 71*a*, 72*a*, 74*a*, and 75*a* and the second communication holes 76 and 77*a*. Movement of air as shown by vertical arrows in FIG. 7B occurs in the crank chambers 63*a* to 63*f* in response to changes in strokes of the plurality of cylinders 61*a* to 61*f*.

At this point, when the pistons 16 of the adjoining cylinders, for example, the first and second cylinders 61*a* and 61*b* move in the same direction, or when the pistons 16 of the second and third cylinders 61*b* and 61*c* move in the same direction, movement of gases is allowed between the non-adjoining cylinders 61*a* and 61*c*. Therefore, in any of the cylinders 61*a* to 61*c*, the piston 16 does not push air out against gas flow.

In addition, when the pistons 16 of the adjacent cylinders, for example, the fourth and fifth cylinders 61*d* and 61*e* move in the same direction, or when the pistons 16 of the fifth and sixth cylinders 61*e* and 61*f* move in the same direction, air is allowed to move between the non-adjoining cylinders 61*d* and 61*f*. Therefore, in any of the cylinders 61*d* to 61*f*, the piston 16 does not push air out against gas flow.

Further, if the pistons 16 of the third and fourth cylinders 61*c* and 61*d* move in the same direction, or if the pistons 16 of the first to fourth cylinders 61*a* to 61*d* move in the same direction, air is allowed to move between the non-adjoining cylinders 61*a* and 61*c* or between the non-adjoining cylinders 61*d* and 61*f*. Therefore, in any of the first to sixth cylinders 61*a* to 61*f*, the piston 16 does not push air out against gas flow.

Accordingly, an effect equivalent to the above-described first embodiment can be obtained.

Further, in this embodiment, even if gases flow from the center toward one end of the cylinder block and crankcase 64 or flow in the opposite direction, gases are not blocked at the crank chambers 63*a* and 63*f* that correspond to the cylinders 61*a* and 61*f* at both the ends. Gas flow is allowed between the non-adjoining cylinders 61*a* and 61*c* and/or the non-adjoining cylinders 61*d* and 61*f*. Therefore, pumping loss can be more certainly reduced in all the cylinders 61*a* to 61*f*.

In each of the above-described embodiments, an inline multi-cylinder engine is described for convenience. However, in a V-type multi-cylinder engine, in a case that the engine has a construction that has difficulty in communication between upper sections of the crank chambers between banks, the present invention can be applied to each bank. Specifically, an in-line six cylinder engine will be described. However, it is a matter of course that pumping loss may be reduced by using both the first communicating hole between the adjoining cylinders and the second communicating hole for the non-adjoining cylinders. Further, the second communicating holes may be formed with a pipe. However, a second communicating passage may be unitarily formed in at least either the cylinder block or the crankcase. In addition, for example, a groove may be provided at a contact surface between the cylinder block and the crankcase when fastened together. Otherwise, for example, the groove may be formed in an inner peripheral surface of the crankcase, and a plate for blocking the groove and the like is provided so that a pair of the non-adjoining crank chambers and the second communicating hole do not communicate, and thereby the second communicating passage may be formed.

As described above, the crank chamber communication structure of a multi-cylinder internal combustion engine in accordance with the present invention allows the movement of gases between the non-adjoining cylinders when the pistons of the adjoining cylinders move in the same direction, and thereby prevents the pistons from pushing gases out against gas flow. Therefore, the present invention provides a crank chamber communication structure of a multi-cylinder internal combustion engine that can more certainly reduce pumping loss, and is useful for all crank chamber communication structures of a multi-cylinder internal combustion engines in which a breathing hole is formed between adjoining crank chambers in a crankcase.

While the invention has been described with reference to example embodiments thereof, it should be understood that the invention is not limited to the example embodiments or constructions. To the contrary, the invention is intended to cover various modifications and equivalent arrangements. In addition, while the various elements of the example embodiments are shown in various combinations and configurations, which are exemplary, other combinations and configurations, including more, less or only a single element, are also within the spirit and scope of the invention.

The invention claimed is:

1. A crank chamber communication structure for a multi-cylinder internal combustion engine having a plurality of partition walls that are formed in a cylinder block that forms a plurality of three or more, cylinders, each of which houses a piston, and in a crankcase, which is fixed to the cylinder block, the partition walls are formed to support a crankshaft and to define a plurality of crank chambers that correspond to the plurality of cylinders, the crank chamber communication structure comprising:

a plurality of respective first communicating holes formed in the plurality of partition walls for communication between respective pairs of adjoining crank chambers separated by an interposed partition wall; and a second communicating hole that is formed at least either of the cylinder block or the crankcase, that is interposed between a first pair of non-adjoining crank chambers between which at least two partition walls among the plurality of partition walls are interposed, and combined with a pipe that passes through at least the two partition walls that are interposed between the first pair of non-adjoining crank chambers so that the second communication hole directly connects between the first pair of non-adjoining crank chambers.

2. The crank chamber communication structure according to claim 1, wherein the first pair of non-adjoining crank chambers are formed in spaces that are positioned inside the pair of respective cylinders among the plurality of cylinders which are positioned at both ends of the cylinder block and that are positioned more adjacent to the crankshaft than the pistons.

3. The crank chamber communication structure according to claim 1, wherein the first pair of non-adjoining crank chambers are formed in spaces that are positioned inside a first outer cylinder among the plurality of cylinders which is positioned at one end of the cylinder block and inside a first inner cylinder which is separated from the first outer cylinder toward a center of the cylinder block, and that are positioned more adjacent to the crankshaft than the pistons.

4. The crank chamber communication structure according to claim 3, further comprising:

a second pair of non-adjoining crank chambers that are separated from the first pair of non-adjoining crank chambers and formed in spaces that are positioned inside a second outer cylinder among the plurality of cylinders which is positioned at the other end of the cylinder block and inside a second inner cylinder which is separated from the second outer cylinder toward the center of the cylinder block with any of the plurality of cylinders interposed therebetween and that are positioned more adjacent to the crankshaft than the pistons; and another second communicating hole for direct communication between the second pair of non-adjoining crank chambers, that is formed at least either of the cylinder block or the crankcase.

5. The crank chamber communication structure according to claim 1, wherein the second communicating hole is formed with a pipe that passes through any of the plurality of partition walls.

6. The crank chamber communication structure according to claim 5, wherein the pipe is formed of metal.

7. The crank chamber communication structure according claim 1, wherein the second communicating hole and the first communicating holes are separated from each other in wall surface directions of the partition walls so that the second communicating hole and the first communicating holes are positioned at opposite ends with the plurality of cylinders interposed therebetween.

8. The crank chamber communication structure according to claim 1, wherein the crankshaft has a phase difference of the pistons, which is different from 180°, between each pair of the cylinders that adjoin each other with the partition wall interposed therebetween.

9. A crank chamber communication structure for a multi-cylinder internal combustion engine, including: a cylinder block that forms a plurality of, three or more, cylinders each of which houses a piston; a crankcase that is fixed to the cylinder block; and the plurality of partition walls that are formed with the cylinder block and the crankcase to support a crankshaft and to define a plurality of crank chambers which correspond to the plurality of cylinders, the crank chamber communication structure comprising:

a plurality of first communicating holes that are formed in at least two of the plurality of partition walls and that communicate between respective pairs of the adjoining crank chambers separated by an interposed partition wall; and a second communicating hole that is interposed between a pair of the non-adjoining crank chambers between which at least two of the plurality of partition walls are interposed and combined with a pipe that passes through at least the two partition walls that are interposed between the first pair of non-adjoining crank chambers so that the second communication hole directly connects between the pair of non-adjoining crank chambers.

* * * * *